United States Patent [19]

Marantz

[11] 3,999,357

[45] Dec. 28, 1976

[54] METHOD OF MAKING DOUBLE WRAP PACKAGE

[75] Inventor: Daniel Richard Marantz, Port Washington, N.Y.

[73] Assignee: American Can Company, Greenwich, Conn.

[22] Filed: Apr. 21, 1975

[21] Appl. No.: 569,962

Related U.S. Application Data

[62] Division of Ser. No. 337,171, March 1, 1973, Pat. No. 3,896,604.

[52] U.S. Cl. ..... 53/27; 53/30 S

[51] Int. Cl.[2] ..... B65B 53/02

[58] Field of Search ..... 53/3, 27, 30 S, 184 S; 206/497; 229/DIG. 12

[56] References Cited

UNITED STATES PATENTS

| | | | |
|---|---|---|---|
| 3,331,503 | 7/1967 | Brown | 53/30 S |
| 3,557,516 | 1/1971 | Brandt | 53/30 S |
| 3,585,777 | 6/1971 | Pesch | 53/184 S |
| 3,670,880 | 6/1972 | Burleson et al. | 206/497 X |
| 3,710,539 | 1/1973 | Cothran et al. | 53/27 |
| 3,766,708 | 10/1973 | Kubo et al. | 53/184 S |
| 3,788,462 | 1/1974 | Meincer | 206/497 X |

*Primary Examiner*—Robert Louis Spruill
*Attorney, Agent, or Firm*—Robert P. Auber; Ira S. Dorman; James W. Bock

[57] ABSTRACT

A film of heat shrinkable plastic material is wrapped about four sides of an object and heat welded. A second heat shrinkable film is wrapped and heat welded about the object at right angles to the wrap of the first film. Both films are wider than the package faces about which they are wrapped. The films are heated to shrink both films and to cause the overlapping portions of the two films to heat bond together.

7 Claims, 8 Drawing Figures

METHOD OF MAKING DOUBLE WRAP PACKAGE

This is a Division of application Ser. No. 337,171, filed Mar. 1, 1973, now U.S. Pat. No. 3,896,604.

BACKGROUND OF THE INVENTION

Bulk transportation of cartoned goods usually involves stacking cartons on a platform or pallet to form a rectangular six sided prism. Such a palletized load is frequently secured with straps to retain its integrity. The pallet or platform represents a sufficient investment to warrant its reuse thereby requiring its return. The weight and size of pallets is sufficient to be a factor in shipping cost. Consequently, unitized loads which do not include a pallet are desirable.

The use of a single wrap of heat shrinkable, heat sealable plastic to unitize a load is known and is shown in such U.S. Pat. Nos. as 3,504,476 to Ehrenfried et al.; 3,585,777 to Pesch; 3,596,434 to Zelnick; and 3,672,116 Ingmarson. Double wrapping with bands of paper narrower than the prism is shown in U.S. Pat. Nos. 2,979,871 to Kieckhefer and 3,253,379 to Foradora. A single heat-shrinkable wrap with the addition of inserts for the exposed top and bottom faces is shown in U.S. Pat. Nos. 3,640,048 to Zelnick and 3,631,649 to Close et al.

SUMMARY OF THE INVENTION

It is an objective of the present invention to provide a method and apparatus for wrapping an object.

It is a further objective of the present invention to provide a method and apparatus for wrapping a rectangular prismatic package such as a group of stacked cartons with shrinkable plastic film to consolidate and integrate the package for palletless handling and to seal the package.

These and other objectives will become apparent from the detailed description of the invention.

The present invention provides palletless unitized loads by wrapping all six sides of a rectangular prism of stacked cartons or the like with shrinkable plastic film. The resultant package is a unitized load of sufficiently high integrity to obviate the need for a pallet. The wrapping, heat sealing and heat shrinking technique to be described provides a package which is sealed against the intrusion of dirt or moisture and confines leakage, dust or odors of the contents. The top and bottom surfaces of the package are of double thickness as are each of the edges thereby providing improved rigidity and durability.

The technique of the present invention involves wrapping a rectangular prismatic package such as stacked cartons with a first film of heat sealable, heat-shrinkable plastic material so as to encompass the top, bottom and two faces of the prism. The ends of the film are heat-sealed together to constitute a sleeve about the prism. The film is wide enough to extend beyond the wrapped faces. Heat, preferably infra-red energy, may be applied along the four edges encompassed by the film to initiate shrinkage of the film thereby causing those portions of the film which extend beyond the prism faces to turn inwardly against the two exposed faces of the prism. A second film of such material is wrapped about the prism orthogonally to the first web to encompass the two exposed faces and the top and bottom of the prism. The second film is also wider than the faces encompassed by it so that it extends slightly beyond the perimeter of the prism. Both films are now simultaneously heat shrunk, preferably with infra-red radiation directed against the top, bottom and the two end faces covered by the second film. The tension exerted by the shrunk films tightly integrates the package. The temperature experienced by the films is high enough to cause the films to bond together or laminate wherever they overlap. The resulting wrapping covers all six sides of the prism and is sealed. The top, bottom, twelve edges and eight corners are protected by two plies of plastic film. The package is consolidated by the tension exerted by the films and is highly resistant to internal shifting, bending or skewing.

DETAILED DESCRIPTION OF A PREFERRED EMBODIMENT

Figures 1, 2A, 2B, 2C, 2D, 2E, 2F, 3:
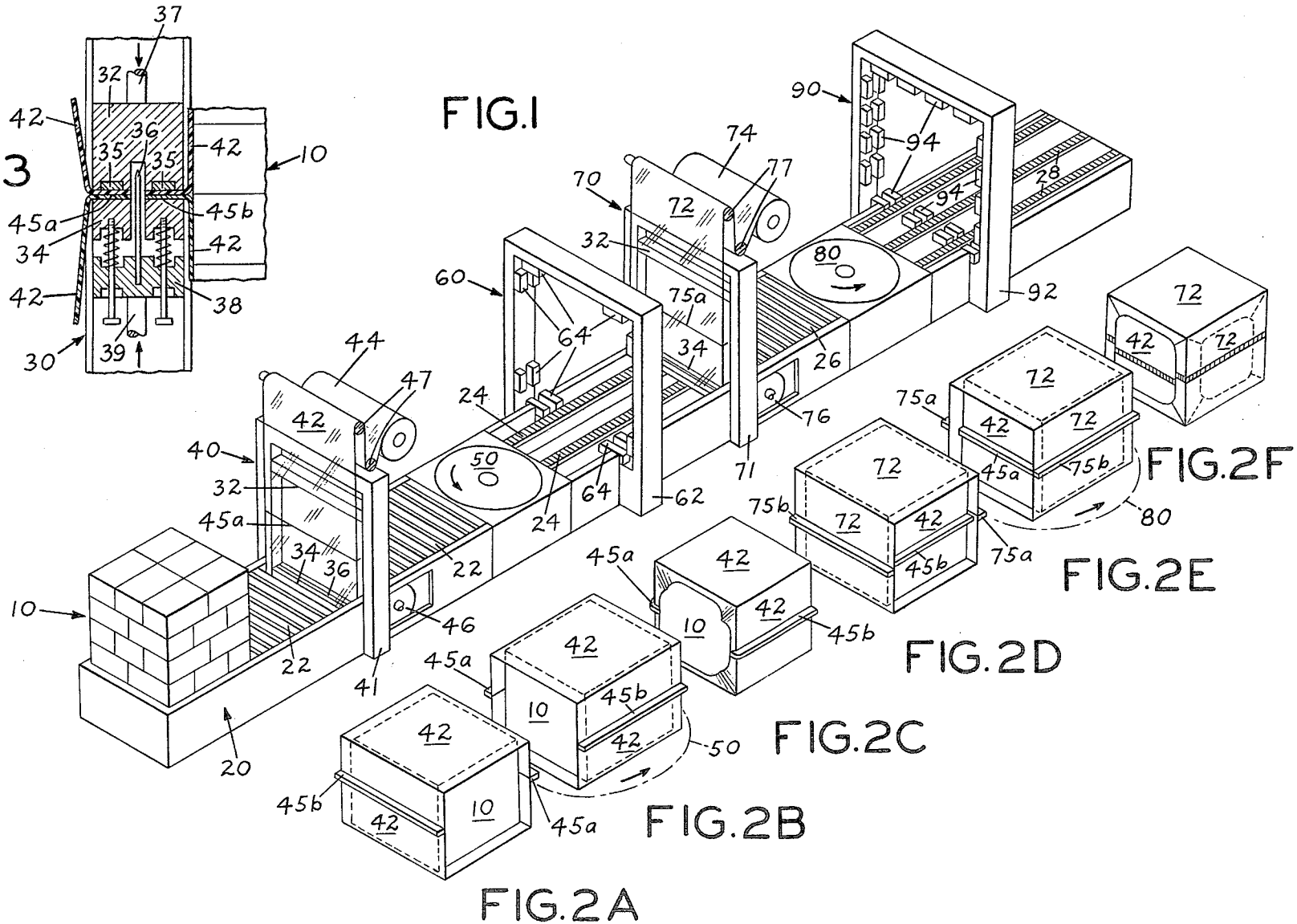
FIG. 1 is an isometric view of apparatus for carrying out the wrapping of the present invention.
FIG. 2A–F is an isometric schematic showing the several steps of wrapping performed by the apparatus of FIG. 1.
FIG. 3 is a detail view in section of the heat sealing and film cutting device used in the apparatus of FIG. 1.

Referring now to the drawings, a load to be wrapped such as a rectangular prism 10 of stacked cartons is deposited on the input end 20 of the wrapping apparatus. A powered conveyor 22 advances the load 10 to and through a first wrapping station 40 at which a film 42 of heat shrinkable, heat sealable plastic is wrapped about the front, top, bottom and rear faces of the load 10.

The first wrapping station 40 comprises a rectangular frame 41 which vertically suspends a curtain 42 of plastic film in front of the advancing load 10. Film to form the curtain 42 is supplied from upper and lower supply rolls 44 and 46. The confronting edges of the film from the two supply rolls are heat sealed together at a horizontal lip seam 45*a*. The film curtain 42 is tensioned by two sets of conventional tensioning rollers 47 located above and below the path of the load along the machine. The lower set of tensioning rollers can not be seen in FIG. 1. The rollers 47 of the tensioning roller sets are biased apart to provide a loop of film 42.

The first wrapping station 40 also includes a heat sealer and cutter 30 is shown in greater detail in FIG. 3. The heat sealer comprises a pair of clamping bars 32 and 34 reciprocably movable toward each other by conventional linear actuators 37 and 39. At least one of the confronting faces of the clamping bar pair includes a pair of spaced parallel ribbon heater elements 35 for rapidly heating the film plies clamped between the bars to effect two spaced parallel lines of heat sealing fusion at 45*a* and 45*b*. One of the clamping bars, such as 34, is provided with a cutter 36 which may be a knife or hot wire or the like. The cutter 36 is arranged to cut subsequent to the clamping and heat sealing by mounting the cutter 36 on a separate bar 38 spring biased away from the lower clamping bar 34 such that continued approaching motion of the actuator rods 37 and 39 causes the cutter 36 to advance after the film 42 has been clamped and sealed thereby severing between the heat sealed seams 45*a* and 45*b*. This style of double seam heat sealer and cutter is conventional and an example is shown in U.S. Pat. No. 3,564,810 to Faletti et al.

As the load 10 is advanced through the first wrapping station 10 by means of powered conveyor 22, the front face of the load encounters the curtain 42 of plastic film provided by supply rolls 44 and 46. The confronting edges of the film are joined together by a heat sealed lip seam 45*a* which was formed in the previous cycle of the apparatus. The advancing load overcomes the tension provided by the bias of the pair of tension roller sets 47 above and below the plane of the conveyor 22. The film is drawn from the loop of film provided by the tensioning rollers and from the supply rollers 44 and 46 to become wrapped across the front, the top and the bottom faces of the load 10. The load continues to advance until the rear face of the load passes through the vertical plane originally defined by the curtain of film 42. At this point, detected by suitable sensors such as photo cells, the actuators 37 and 39 are activated to move the clamping bars 32 and 34 toward each other. The clamping bars intercept the film from supply rolls 44 and 46 and draw the upper film down and the lower film up across the rear face of the load. The two plies of film, one from each of rolls 44 and 46, are clamped under some tension between the bars 32 and 34. Energy is supplied to the sealer elements 35 to cause fusion and lamination of the films. The sealer elements 35 may be resistance ribbons, inductive strip heaters, ultrasonic transducers or any other suitable known device for providing line of heat for autogenous welding of the films. Adhesives could be used, but the simplicity of heat sealing commends its use. After sealing has been completed along the spaced parallel lines dictated by the sealer elements 35 and after cooling for a sufficient time to assure adequate strength, bar 38 carrying cutter 35 is urged relatively toward upper clamping bar 32 to cause the cutter to sever the laminated films between the seams 45*a* and 45*b* formed by the two sealer elements 35. The load 10 is now wrapped in a sleeve of film which encompasses the front, top, bottom and rear faces. The seam 45*a* which was made during the previous machine cycle is located horizontally across the front face and the seam 45*b* just made is located horizontally across the rear face. A new seam 45*a*, just made, provides a new vertical curtain of film 42 to await the next cycle of the machine.

The load with the first wrapping of film is shown in FIG. 2A. The width of the film 42 is greater than the width of the faces of the load which it encompasses to leave unsupported overhangs about the two exposed faces.

The load 10 with the first wrap 42 is now further advanced along the conveyer 22 and deposited on a turntable 50 which rotates the load 90° about a vertical axis. The load now has the attitude illustrated in FIG. 2B. The wrapped edges are now in alignment with the machine direction and the overhanging portions of the film also extend longitudinally of the machine.

The load 10 with the first wrap is advanced by a conveyor 24 through a first shrink station 60 which comprises a frame 62 supporting infra-red heater elements 64 proximate the corners of the opening through the frame 60. The wrapped edges and their proximities are heated sufficiently by the heaters 64 to initiate shrinkage of the heat shrinkable film. This initial shrinkage causes the unsupported overhanging portions of the film to turn inwardly against the exposed faces of the load as is illustrated in FIG. 2C.

The load with the first wrap partially shrunk is advanced by a conveyor 26 through a second wrapping station 70 substantially identical to the first wrapping station 40. A film curtain 72 is supplied by supply rolls 74 and 76. The curtain is heat seamed at 75*a* during the previous cycle. The film 72 is wrapped about the leading exposed face, the top and bottom faces and is drawn across and seamed at the trailing exposed face using a sealer cutter device 30 as shown and described above in connection with the first wrapping station 40 and FIG. 3. The double wrapped load has the appearance of FIG. 2D. The film 72 is also wider than the faces wrapped to leave unsupported overhanging portions.

The double wrapped load is delivered by conveyor 26 to a turntable 80 which rotates the load 90° about a vertical axis. The edges just wrapped by film 72 are now aligned with the machine direction and the double wrapped load has the appearance of FIG. 2E.

The double wrapped load is advanced by a final conveyor 28 through a second heat shrink station 90 comprising a rectangular frame 92 which supports a plurality of infra-red heater elements 94 extending uniformly about the opening of the frame 92. The whole of the four faces wrapped at the second station 70 with film 72 are more or less evenly heated to cause extensive shrinkage of both films 72 and 42. The temperature induced in the films is sufficient to cause the films to permanently heat seal or bond together wherever they overlap at the top and bottom faces and in the proximity of all 12 edges. The portions of film 72 which were unsupported and overhanging turn inwardly as a result of the shrinkage and bond to the underlying layer of film 42. The completed wrapped, sealed and shrunk package is illustrated in FIG. 2F.

Although various plastic films having shrink capability could be used, biaxially oriented polyethylene having a 70 percent lengthwise and 30 percent crosswise shrink is preferred. Suitable heat shrinkable films are sold by the American Can Company, Greenwich, Connecticut, U.S.A. The invention can be employed with plastic films of uniform shrinkage characteristics as well as with films having a substantially uniaxial longitudinal shrink characteristic. The invention can be employed with films which shrink by chemical reaction or by evaporation of a film swelling solvent.

The machine of the present invention has been illustrated as a version employing turntables 50 and 80 to achieve 90° rotation where needed. Another version of the machine achieves the result by employing conveyor portions which operate at right angles to each other such that the load advances through the first wrapping station in a first direction and then advances transverse to that first direction through the first shrink station and the second wrapping station, then the load advances in a direction parallel to the first direction through the final shrink station.

The double wrapped package produced by the present invention is sealed against dirt, weather, atmosphere, internal and external leakage and the like. The top and bottom faces and all edges and corners are of double thickness to better withstand handling. The smooth surface provided by the films is an aid in sliding the load. The load is consolidated and protected against shifting or bending. Except for extraordinarily heavy loads, no pallet is necessary. Where wanted, a pallet can be included in the load and encompassed by the film wrap or can be employed externally of the film wrap.

Most of the advantages of the present invention can be realized with a double shrink wrap in which one of the sleeves is only as wide as the faces of the load which it wraps and the other sleeve is wider than the faces of the load which it wraps. When the first sleeve is that which is only as wide as the load, there is no overhang and the first heat shrink step can be eliminated with some saving in apparatus and operating cost.

When the second sleeve is that which is only as wide as the load, the first sleeve does have an overhang and the first shrink step is required as well as the second or final shrink step. In either case, the package will have eight rather than twelve double thickness edges. The selection of which or both sleeves are to be wider than the load is subjective and depends in part upon the proportions of the load prism and the nature of the load contents.

What is claimed is:

1. A method of wrapping an object with shrinkable plastic film comprising the steps of establishing a first plane of film at least as wide as the dimensions of the object about which the film is to be wrapped, relatively advancing the object through the plane of the film to wrap the film about the object, bonding the film together to form a first sleeve of film about the object, establishing a second plane of film at least as wide as the dimensions of the object about which the film is to be wrapped, advancing the object through the second plane of film in a direction approximately at right angles to the direction of wrapping of the first sleeve of film to wrap the film of the second plane about the object, bonding the film of the second plane together to form a second sleeve of film about the object, at least one of the first and second planes of film being wider than the dimensions of the object about which said film is wrapped, simultaneously heat shrinking both sleeves to tightly encompass the object, and heat laminating the sleeves to each other where they overlap.

2. A method of wrapping and consolidating a load in the form of a rectangular prismatic stack of cartons comprising the steps of establishing a plane of a first heat sealable, heat shrinkable plastic film of a width greater than the width of the faces of the load about which it is to be wrapped, advancing the load through the plane of the first film to draw the film about the front, top and bottom faces of the load, drawing the film together across the rear face of the load, heat sealing the film to itself along spaced parallel lines of heat sealing, severing the film between the lines of heat sealing to form a first sleeve of film about the load, heating the film in the proximity of the wrapped edges of the load to partially shrink the film and to draw the margins of the film against the exposed faces of the load, establishing a second plane of heat sealable, heat shrinkable plastic film of a width greater than width of the faces of the load about which it is to be wrapped, advancing the load through the second plane of film in a direction approximately at right angles to the direction of wrapping of the first sleeve of film to draw the film of the second plane about the now leading, top and bottom faces of the load, drawing the film together across the now trailing face of the load, heat sealing the film to itself along spaced parallel lines of heat sealing, severing the film between the lines of heat sealing to form a second sleeve of film about the load at right angles to the first sleeve, heating the films to shrink both sleeves to tightly encompass the load and to heat laminate the sleeves to each other where they overlap.

3. The method of claim 2 wherein the load is rotated approximately 90° about a vertical axis before the first heating step and wherein the load is again rotated approximately 90° before the second heating step.

4. The method of claim 2 wherein the heat sealable, heat shrinkable plastic is biaxially oriented polyethylene having a greater shrink capacity in the direction of wrapping.

5. The method of claim 2 wherein the first heating step directs infra-red radiation at the proximities of the edges of the load covered by the first sleeve.

6. The method of claim 5 wherein the second heating step directs infra-red radiation at the top, bottom and those faces covered by the second sleeve.

7. A method of wrapping and consolidating a load in the form of a rectangular prismatic stack of cartons comprising the steps of establishing a plane of a first heat sealable, heat shrinkable plastic film of a width at least as wide as the width of the faces of the load about which it is to be wrapped, advancing the load through the plane of the first film to draw the film about the front, top and bottom faces of the load, drawing the film together across the rear face of the load, heat sealing the film to itself along spaced parallel lines of heat sealing, severing the film between the lines of heat sealing to form a first sleeve of film about the load, establishing a second plane of heat sealable, heat shrinkable plastic film of a width greater than the faces of the load about which it is to be wrapped, advancing the load through the second plane of film in a direction approximately at right angles to the direction of wrapping of the first sleeve of film to draw the film of the second plane about the now leading, top and bottom faces of the load, drawing the film together across the now trailing face of the load, heat sealing the film to itself along spaced parallel lines of heat sealing, severing the film between the lines of heat sealing to form a second sleeve of film about the load at right angles to the first sleeve, heating the films to shrink both sleeves to tightly encompass the load and to bond the sleeves to each other where they overlap.

* * * * *